US008883264B2

(12) United States Patent
Yang et al.

(10) Patent No.: US 8,883,264 B2
(45) **Date of Patent: *Nov. 11, 2014**

(54) METHOD OF POWDER COATING AND POWDER-COATED FUSER MEMBER

(71) Applicant: Xerox Corporation, Norwalk, CT (US)

(72) Inventors: Suxia Yang, Mississauga (CA); Qi Zhang, Milton (CA); Edward G Zwartz, Mississauga (CA); Yu Qi, Oakville (CA); Gordon Sisler, St. Catharines (CA); David Charles Irving, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 16 days.

This patent is subject to a terminal disclaimer.

(21) Appl. No.: 13/666,408

(22) Filed: Nov. 1, 2012

(65) Prior Publication Data

US 2014/0121298 A1 May 1, 2014

(51) Int. Cl.

| | |
|---|---|
| ***B05D 1/04*** | (2006.01) |
| ***B05D 1/02*** | (2006.01) |
| ***B05D 5/00*** | (2006.01) |
| ***B05D 7/24*** | (2006.01) |

(52) U.S. Cl.
USPC ..... 427/474; 427/475; 427/421.1; 427/427.4; 427/485

(58) Field of Classification Search
CPC . G03G 15/0264; G03G 15/2053; B05D 1/06; B05D 1/02; B05D 1/025; B05B 1/02; B05B 5/00; B05B 5/025; B05B 5/032
USPC ..... 399/320; 239/698; 427/470, 474, 475, 427/421.1, 427.4, 485
See application file for complete search history.

(56) References Cited

U.S. PATENT DOCUMENTS

| | | | | | |
|---|---|---|---|---|---|
| 3,770,482 | A | * | 11/1973 | Millar et al. | 427/470 |
| 4,228,961 | A | * | 10/1980 | Itoh | 239/698 |
| 5,729,813 | A | * | 3/1998 | Eddy et al. | 399/333 |
| 5,922,131 | A | * | 7/1999 | Haas | 118/629 |
| 6,113,830 | A | * | 9/2000 | Chen et al. | 264/241 |
| 2010/0226701 | A1 | * | 9/2010 | Moorlag | 399/333 |

OTHER PUBLICATIONS

SpectrAL Series "Fumed Alumina for Powder Coating Processes", Cabot Corporation, 2005.*

* cited by examiner

*Primary Examiner* — Timothy Meeks
*Assistant Examiner* — Ann Disarro
(74) *Attorney, Agent, or Firm* — MH2 Technology Law Group LLP

(57) ABSTRACT

Methods for powder coating that include applying a powder coating composition to a substrate via an electrostatic gun. The powder coating composition includes a mixture of two or more materials having different densities, such as a mixture of aerogel particles and fluoropolymer-containing particles. The electrostatic gun can have a high-voltage generator that generates a negative polarity voltage between about 0 KV and about 100 KV during application of the powder coating composition, and the electrostatic gun can have a round spray nozzle. Methods of making fuser members using such powder coating methods, fuser members prepared by such methods, and methods of preparing low gloss images using such fuser members.

20 Claims, 8 Drawing Sheets

METHOD OF POWDER COATING AND POWDER-COATED FUSER MEMBER

CROSS-REFERENCE TO RELATED APPLICATIONS

Attention is directed to U.S. patent application Ser. No. 13/448,808, filed Apr. 17, 2012, to Moorlag et al.; and U.S. patent application Ser. No. 13/448,822, filed Apr. 17, 2012, to Moorlag et al. The contents of these patent applications are hereby incorporated by reference in their entirety.

BACKGROUND

Embodiments herein are generally drawn to methods of powder coating substrates. Certain embodiments are drawn to substrates (such as, fuser member substrates, among others) coated with outer layers that have a low roll gloss (surface gloss). Some embodiments are drawn to fuser members useful in electrophotographic imaging apparatuses, printers, and the like, having a low gloss outer layer that can be used to produce low gloss prints.

Controlling print gloss is desired by many customers. In general, there are two approaches to achieve different print gloss for printers with a contact fusing system. One is to modify the toner and the other is to modify the fuser member surface. In the electrophotographic printing process, a toner image can be fixed or fused upon a support (e.g., a paper sheet) using a fuser member.

The use of low gloss fuser members (rolls or belts, among others known in the art) to change print gloss has advantages over low gloss toner by enabling a short changeover time, as well as, extending the gloss range that can be obtained. Low gloss prints have been obtained using fluoropolymer and silica aerogel fuser topcoat/outer layers on fuser rolls. Such fluoropolymer/aerogel fuser coatings have been prepared by spray coating solvent dispersions of such coatings and melt-curing. However, the spray coating process results in high variance between samples, due to particle settling. A desirable processing method for production coating of fuser members is powder coating.

Powder coating involves the application of a free flowing, dry powder to a surface, followed by curing. The powder is electrostatically charged, and then directed to a grounded component to form the coating layer. With the application of heat the powder melts and flows to form a cured coating. Powder coating mixtures containing two powders (such as, PFA and aerogel powders) present challenges due to dissimilar densities and flow behavior of the different component powders, and lead to inhomogeneous powder mixtures and changing concentrations of aerogel on coated components.

Curing of mixed fluoropolymer/aerogel coatings is additionally problematic due to inefficient wetting between dissimilar particles upon melting of the fluoropolymer. This leads to a lack of cohesion between the cured surface and the powder coated cured topcoats comprising fluoropolymer particles and aerogel particles. The uneven aerogel concentration that occurs during powder coating and poor wetting between the fluoropolymer and aerogel particles can result in large voids and inclusions. An extra processing step, such as washing of the particles with the addition of surface functionalities, can improve wetting and curing; however, this step promotes little to no association between particles during powder coating. Additionally, it is desirable to avoid the incorporation of extra steps for production coating.

It is desirable, therefore, to produce low gloss prints without the need to change the toner in an electrophotographic imaging apparatus or printer. Further, it is desirable to produce fuser members that are durable and easily manufactured. In addition, a fuser member coating having an even distribution of texture forming particles (e.g., aerogel particles) that enables transfer of toner to form prints of variable gloss is desirable. Certain embodiments herein can address these issues.

SUMMARY

Certain embodiments are drawn to methods for powder coating, including applying a powder coating composition to a substrate via an electrostatic gun. The powder coating composition can include a mixture of a first material and a second material and the first and second materials can have different densities. The electrostatic gun can have at least one electrode and a high-voltage generator, and the high-voltage generator generates a negative polarity voltage between about 0 KV and about 100 KV that is applied to the electrode during application of the powder coating composition.

Some embodiments are drawn to methods of making a fuser member, including applying a powder coating composition to the surface of a fuser member via an electrostatic gun. The powder coating composition can comprise a mixture of a plurality of aerogel particles and a plurality of fluoropolymer-containing particles and the fuser member is grounded. The electrostatic gun can have at least one electrode and a high-voltage generator, and the high-voltage generator can generate a negative polarity voltage between about 0 KV and about 100 KV that is applied to the electrode during application of the powder coating composition. The electrostatic gun can have a round spray nozzle or a flat spray nozzle.

Certain embodiments are drawn to a fuser member having a substrate and an outer layer disposed on the substrate. The outer layer can contain a fluoropolymer-containing matrix comprising between about 0.1 weight percent and about 10 weight percent aerogel particles and between about 0.1 weight percent and about 5 weight percent fumed alumina particles of the total solids in the outer layer. The outer layer can have a surface gloss of between about 5 Gardner gloss units (ggu) and about 45 ggu when measured at 75°. Further, the outer layer is prepared by a method including applying a powder coating composition to the surface of a grounded fuser member via an electrostatic gun. The electrostatic gun can have at least one electrode and a high-voltage generator, and the high-voltage generator can generate a negative polarity voltage between about 0 KV and about 100 KV that is applied to the electrode during application of the powder coating composition. Also, the electrostatic gun can have a round spray nozzle.

BRIEF DESCRIPTION OF THE DRAWINGS

FIG. 7 includes graphs showing the measured gloss for different printed colors using the Color Xpressions Select (CXS) paper and the Digital Color Elite Gloss (DCEG) paper (both papers available from Xerox).

DETAILED DESCRIPTION

Figure 1:
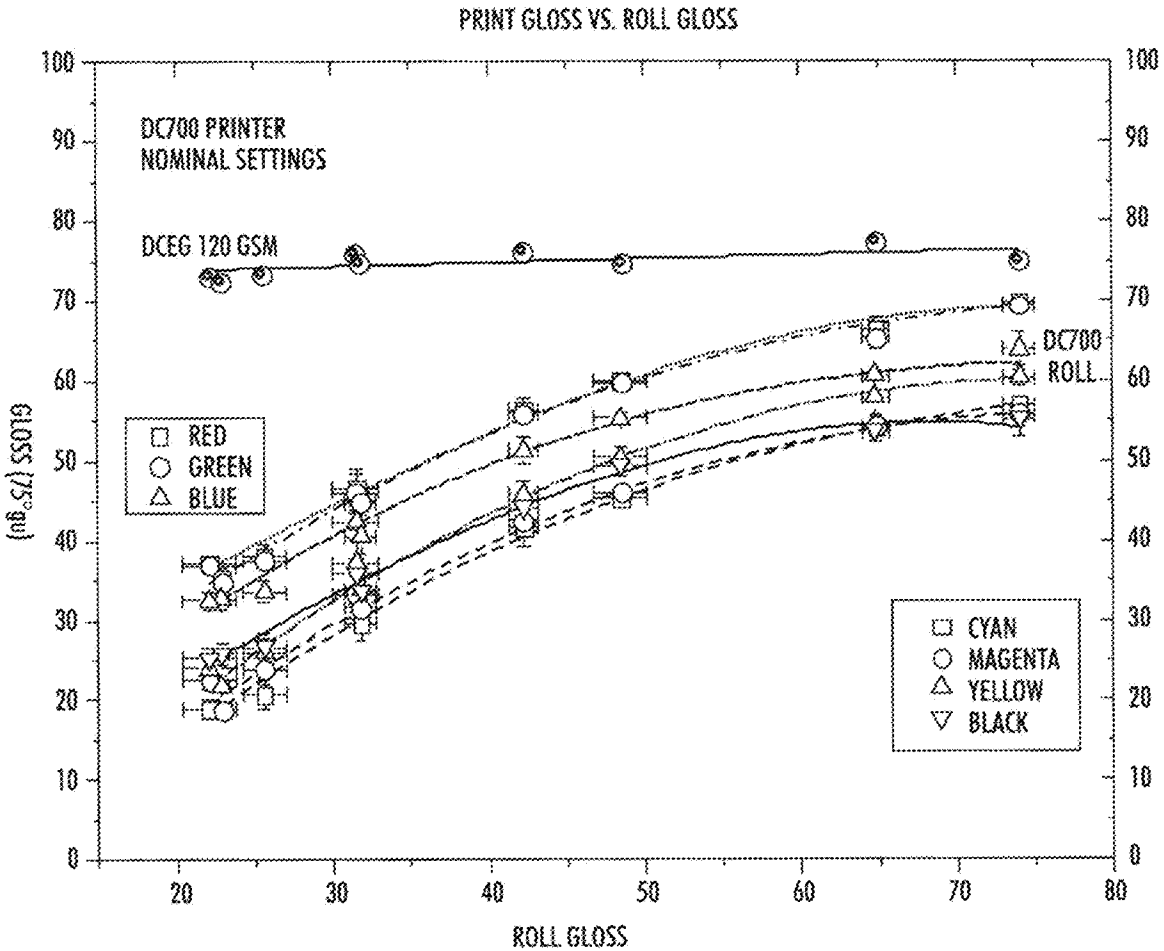
FIG. 1 is a graph showing the relationship between print gloss and roll gloss.

As used herein, the term "hydrophobic/hydrophobicity" and the term "oleophobic/oleophobicity" refer to the wettability behavior of a surface that has, e.g., a water and hexadecane (or hydrocarbons, silicone oils, etc.) contact angle of approximately 90° or more, respectively. For example, on a hydrophobic/oleophobic surface, a ~10-15 μL water/hexadecane drop can bead up and have an equilibrium contact angle of approximately 90° or greater.

As used herein, the term "ultrahydrophobicity/ultrahydrophobic surface" and the term "ultraoleophobic/ultraoleophobicity" refer to wettability of a surface that has a water/hexadecane contact angle of about 120° or greater.

The term "superhydrophobicity/superhydrophobic surface" and the term "superoleophobic/superoleophobicity" refer to wettability of a surface that has a water/hexadecane contact angle of approximately 150° or greater and has a ~10-15 μL water/hexadecane drop roll freely on the surface tilted a few degrees from level. The sliding angle of the water/hexadecane drop on a superhydrophobic/superoleophobic surface can be about 10° or less. On a tilted superhydrophobic/superoleophobic surface, because the contact angle of the receding surface is high and the interface at the uphill side of the drop has only a low tendency to stick to the solid surface, gravity can overcome the resistance of the drop to slide on the surface. A superhydrophobic/superoleophobic surface can be described as having a very low hysteresis between advancing and receding contact angles (e.g., 40° or less). Note that larger drops can be more affected by gravity and tend to slide easier, whereas smaller drops tend to be more likely to remain stationary or in place.

Certain embodiments, detailed below, permit the production of low gloss prints using low gloss fuser members without changing the toner in an electrophotographic imaging apparatus/printer. Some embodiments are drawn to unique powder coating processes and conditions for achieving powder coated low gloss fuser members for low gloss print applications. Embodiments can have the advantage of fast changeover from high gloss to low gloss printing and can be used to achieve a wide range of print glosses.

Introducing a fine surface roughness to a fuser member can permit production of images having lower gloss when printed using such a fuser member, when compared to images printed using a fuser member having a smooth surface. In some embodiments, an aerogel in the outer layer/release layer of a fuser member can be employed to provide fine surface roughness. In certain embodiments, a low gloss fuser member can be fabricated by incorporating an aerogel (e.g., silica aerogel) into a fluoropolymer-containing (e.g., perfluoroalkoxy) topcoat/outer layer using positively charged particles comprising alumina, silica, zirconia, or germania (e.g., tribo-charging powder additives). To produce uniformly low gloss prints, it is desirable to provide uniform deposition/distribution of texture forming particles (e.g., aerogel particles) on a fuser member.

As discussed above, there are two approaches to achieve different print gloss for electrophotographic imaging apparatuses with a contact fusing system. One is to modify the toner and the other is to modify the fuser member surface. FIG. 1 is a graph showing the relationship between print gloss (y-axis) and roll gloss (x-axis) for single toner layer colors cyan, magenta, yellow and black, and process (two toner layer) colors red, green and blue. There is a correlation of roll gloss to print gloss, as shown in FIG. 1. A lower roll gloss (e.g., increased fine surface roughness) correlates with lower print gloss and a higher roll gloss (e.g., smooth surface) correlates with higher print gloss.

Some embodiments are drawn to methods for powder coating a substrate (such as, a fuser member, among other substrates). Such methods can comprise applying a powder coating composition to the substrate via an electrostatic gun (e.g., a corona gun). The powder coating composition can comprise a mixture of a first material and a second material and the first and second materials can have different densities. In some embodiments, the mixture can comprise a plurality of aerogel particles (e.g., as a first material) and a plurality of fluoropolymer-containing particles (e.g., as a second material). In some embodiments, the powder coating composition can further comprise a plurality of positively charged particles comprising alumina, silica, zirconia, or germania. The substrate can be grounded during application of the powder coating composition. The electrostatic gun can comprise at least one electrode and a high-voltage generator, and the high-voltage generator can generate a negative polarity voltage between about 0 KV and about 100 KV, between about 20 KV and about 80 KV, or between about 40 KV and about 60 KV that is applied to the electrode during application of the powder coating composition. In some embodiments, a negative polarity voltage of about 100 kilovolts (kV or KV) is generated by the high-voltage generator and applied to the electrode during application of the powder coating composition. In certain embodiments the electrostatic gun can have a round spray nozzle/tip or a flat spray nozzle/tip. In some embodiments the electrostatic gun can have spray nozzle/tip geometry that is round.

The substrate can be any substrate known in the art that is suitable for powder coating. In some embodiments, the substrate can be a fuser member, such as a fuser roll, among others known in the art. In some embodiments, the substrate can comprise metal (e.g., metal used in automobiles and household appliances, among others). The substrate can comprise medium density fiberboard in certain embodiments. The substrate when powder coated can be suitable for non-stick cookery, materials resistant to fouling by marine contaminants, self-cleaning windows and other architectural materials, machinery coatings, mold-release packaging, ink and toner packaging, anti-graffiti components, or ink-jet printing and oil-less printing, among other applications.

In some embodiments, the applied powder coating composition can be cured, thereby forming a release layer/outer layer on the substrate. The curing can comprise heating the applied powder coating composition to a temperature between about 255° C. and about 400° C., between about 260° C. and about 380° C., or between about 280° C. and about 350° C., in certain embodiments. In certain embodiments, the release layer/outer layer can have a thickness of between about 5 microns and about 250 microns, between about 10 microns and about 100 microns, between about 20 microns and about 80 microns, or between about 30 microns and about 50 microns. In some embodiments, the release layer/outer layer can have a surface gloss of between about 5 ggu (Gardner gloss units) and about 45 ggu, between about 10 ggu and about 40 ggu, or between about 15 ggu and about 35 ggu when measured at 75°.

The release layer/outer layer can have a surface free energy that can be less than the surface energy of its fluoropolymer base (e.g., cured fluoropolymer-containing particles) that is used in the outer layer. In embodiments, fluoropolymers with aerogel particles dispersed therein can result in a release layer having a surface energy of less than about 20 $mN/m^2$. In embodiments the surface free energy can be less than about 10 $mN/m^2$ for a superhydrophobic surface, between about 10 $mN/m^2$ and about 2 $mN/m^2$, between about 10 $mN/m^2$ and about 5 $mN/m^2$, or between about 10 $mN/m^2$ and about 7 $mN/m^2$.

Fluoropolymers, such as, Teflon and PFA, among others, are commonly processed from powders and then brought to a melting temperature of from about 300° C. to about 380° C. to form a coherent coating. When aerogel and fluoropolymer containing particles are combined and brought to melting, a fused fluoropolymer matrix can be produced with embedded aerogel particles. The release layer incorporates aerogel particles dispersed throughout a fluoropolymer matrix in ratios discussed below.

Powder coating is a desirable processing method for fuser coatings; however, fluoropolymer and aerogel powders have a tendency to separate during powder coating processing resulting in incomplete curing and non-homogeneous release layers. Fluoropolymer powder (e.g., fluoropolymer-containing particles) and aerogel powder are two dissimilar powders that can be coated and cured together to form a fuser topcoat suitable to prepare low gloss prints. The addition of a tribocharging powder/positively charged particles of opposite charge to the fluoropolymer-containing particles and the aerogel particles (both negatively charged) can result in an association forming between powders, which can result in a homogenous mixture throughout the powder coating process. Positive tribocharging powders/positively charged particles mixed with fluoropolymer-containing particles and aerogel particles can enhance wetting while curing to yield cohesive coatings for low gloss fusing applications.

In embodiments, the powder coating composition can comprise between about 0.1 weight percent and about 5 weight percent, between about 0.2 weight percent and about 5 weight percent, or between about 0.5 weight percent and about 2 weight percent aerogel particles of the total solids in the powder coating composition. In certain embodiments, the aerogel particles can have an average particle size between about 1 micron and about 100 microns, between about 3 microns and about 50 microns, or between about 5 microns and about 20 microns. The aerogel particles can have a surface area per gram of between about 400 $m^2/g$ and about 1200 $m^2/g$, between about 500 $m^2/g$ and about 1200 $m^2/g$, or between about 700 $m^2/g$ and about 900 $m^2/g$.

Aerogels can be described, in general terms, as gels that have been dried to a solid phase by removing pore fluid and replacing the pore fluid with air. As used herein, an "aerogel" refers to a material that is generally a very low density ceramic solid, typically formed from a gel. The term "aerogel" is thus used to indicate gels that have been dried so that the gel shrinks little during drying, preserving its porosity and related characteristics. In contrast, "hydrogel" is used to describe wet gels in which pore fluids are aqueous fluids. The term "pore fluid" describes fluid contained within pore structures during formation of the pore element(s). Upon drying, such as by supercritical drying, aerogel particles are formed that contain a significant amount of air, resulting in a low density solid and a high surface area. In various embodiments, aerogels are thus low-density microcellular materials characterized by low mass densities, large specific surface areas and very high porosities. Aerogels can be characterized by their unique structures that comprise a large number of small interconnected pores. After the solvent is removed, the polymerized material is pyrolyzed in an inert atmosphere to form the aerogel.

Any suitable aerogel component can be used. In embodiments, the aerogel component can be, for example, selected from inorganic aerogels, organic aerogels, carbon aerogels, and mixtures thereof. In certain embodiments, ceramic aerogels can be suitably used. These aerogels can comprise silica, but can also comprise metal oxides, such as alumina, titania and zirconia, or carbon, and can optionally be doped with other elements such as a metal. In some embodiments, the aerogel component can comprise aerogels chosen from polymeric aerogels, colloidal aerogels, and mixtures thereof.

The aerogel component can be either formed initially as the desired sized particles, or can be formed as larger particles and then reduced in size to the desired size. For example, formed aerogel materials can be ground, or they can be directly formed as nanometer- to micron-sized aerogel particles.

Aerogel particles of embodiments can have porosities of from about 50 percent to about 99.9 percent, in which the aerogel can contain about 99.9 percent empty space. In embodiments the aerogel particles can have porosities of from about 50 percent to about 99.0 percent, or from about 50 percent to about 98 percent. In embodiments, the pores of aerogel components can have diameters of from about 2 nm to about 500 nm, or from about 10 nm to about 400 nm, or from about 20 nm to about 100 nm. In some embodiments, aerogel components can have porosities of more than about 50 percent, pores with diameters of less than about 100 nm or less than about 20 nm. In embodiments, the aerogel components can be in the form of particles having a shape that is spherical, or near-spherical, cylindrical, rod-like, bead-like, cubic, platelet-like, and the like.

In embodiments, the aerogel components include aerogel particles, powders, or dispersions ranging in average volume particle size of from about 1 μm to about 100 μm, about 3 μm to about 50 μm, or about 5 μm to 20 μm. The aerogel components can include aerogel particles that appear as well dispersed single particles or as agglomerates of more than one particle or groups of particles within the fluoropolymer material.

Generally, the type, porosity, pore size, and amount of aerogel used for an embodiment can be chosen based upon the desired properties of the resultant composition and upon the properties of the polymers into which the aerogel is being combined.

The continuous and monolithic structure of interconnecting pores that characterizes aerogel components also leads to high surface areas and, depending upon the material used to make the aerogel, the electrical conductivity can range from highly thermally and electrically conducting to highly thermally and electrically insulating. Further, aerogel components in embodiments can have surface areas per gram ranging from about 400 $m^2/g$ to about 1200 $m^2/g$, from about 500 $m^2/g$ to about 1200 $m^2/g$, or from about 700 $m^2/g$ to about 900 $m^2/g$. In embodiments aerogel components can have electrical resistivities greater than about $1.0\times10^{-4}$ Ω-cm, such as in a range of from about 0.01 Ω-cm to about $1.0\times10^{16}$ Ω-cm, from about 1 Ω-cm to about $1.0\times10^{8}$ Ω-cm, or from about 50 Ω-cm to about 750,000 Ω-cm. Different types of aerogels used in various embodiments can also have electrical resistivities that span from conductive, about 0.01 Ω-cm to about 1.00 Ω-cm, to insulating, more than about $10^{16}$ Ω-cm. Conductive aerogels of embodiments, such as carbon aerogels, can be combined with other conductive fillers to produce combinations of physical, mechanical, and electrical properties that are otherwise difficult to obtain.

Aerogels that can suitably be used in embodiments can be divided into three major categories: inorganic aerogels, organic aerogels, and carbon aerogels. In embodiments, the release layer can contain one or more aerogels chosen from inorganic aerogels, organic aerogels, carbon aerogels and mixtures thereof. For example, embodiments can include multiple aerogels of the same type, such as combinations of two or more inorganic aerogels, combinations of two or more organic aerogels, or combinations of two or more carbon aerogels, or can include multiple aerogels of different types, such as one or more inorganic aerogels, one or more organic aerogels, and/or one or more carbon aerogels. For example, a chemically modified, hydrophobic silica aerogel can be combined with a high electrical conductivity carbon aerogel to simultaneously modify the hydrophobic and electrical properties of a composite and achieve a desired target level of each property.

Inorganic aerogels, such as silica aerogels, are generally formed by sol-gel polycondensation of metal oxides to form highly cross-linked, transparent hydrogels. These hydrogels are subjected to supercritical drying to form inorganic aerogels.

Organic aerogels are generally formed by sol-gel polycondensation of resorcinol and formaldehyde. These hydrogels are subjected to supercritical drying to form organic aerogels.

Carbon aerogels are generally formed by pyrolyzing organic aerogels in an inert atmosphere. Carbon aerogels are composed of covalently bonded, nanometer-sized particles that are arranged in a three-dimensional network. Carbon aerogels, unlike high surface area carbon powders, have oxygen-free surfaces, which can be chemically modified to increase their compatibility with polymer matrices. In addition, carbon aerogels are generally electrically conductive, having electrical resistivities of from about 0.005 Ω-cm to about 1.00 Ω-cm. In some embodiments, the composite can contain one or more carbon aerogels and/or blends of one or more carbon aerogels with one or more inorganic and/or organic aerogels.

Carbon aerogels that can be included in embodiments exhibit two morphological types, polymeric and colloidal, which have distinct characteristics. The morphological type of a carbon aerogel depends on the details of the aerogel's preparation, but both types result from the kinetic aggregation of molecular clusters. That is, nanopores, primary particles of carbon aerogels that can be less than about 20 Å (Angstroms) and that can be composed of intertwined nanocrystalline graphitic ribbons, cluster to form secondary particles, or mesopores, which can be from about 20 Å to about 500 Å. These mesopores can form chains to create a porous carbon aerogel matrix.

In embodiments, carbon aerogels can be combined with, coated, or doped with a metal to improve conductivity, magnetic susceptibility, and/or dispersibility. Metal-doped carbon aerogels can be used in embodiments alone or in blends with other carbon aerogels and/or inorganic or organic aerogels. Any suitable metal, or mixture of metals, metal oxides and alloys can be included in embodiments in which metal-doped carbon aerogels can be used. In some embodiments, the carbon aerogels can be doped with one or more metals chosen from transition metals (as defined by the Periodic Table of the Elements) and aluminum, zinc, gallium, germanium, cadmium, indium, tin, mercury, thallium and lead. In certain embodiments, carbon aerogels can be doped with copper, nickel, tin, lead, silver, gold, zinc, iron, chromium, manganese, tungsten, aluminum, platinum, palladium, and/or ruthenium. For example, in embodiments, copper-doped carbon aerogels, ruthenium-doped carbon aerogels and mixtures thereof can be included in the composite.

For example, as noted earlier, in embodiments in which the aerogel components comprise nanometer-scale particles, these particles or portions thereof can occupy inter- and intramolecular spaces within the molecular lattice structure of the polymer, and thus can prevent water molecules from becoming incorporated into those molecular-scale spaces. Such blocking can decrease the hydrophilicity of the overall composite. In addition, many aerogels are hydrophobic. Incorporation of hydrophobic aerogel components can also decrease the hydrophilicity of the composites of embodiments. Composites having decreased hydrophilicity, and any components formed from such composites, have improved environmental stability, for example, under conditions of cycling between low and high humidity.

The aerogel particles can include surface functionalities such as, alkylsilane, alkylchlorosilane, alkylsiloxane, polydimethylsiloxane, aminosilane and methacrylsilane, among others known in the art. In embodiments, the surface treatment material contains functionality reactive to aerogel that result in modified surface interactions. Surface treatment also helps enable non-stick interaction on the composition surface.

In addition, the porous aerogel particles can interpenetrate or intertwine with the fluoropolymer and thereby strengthen the polymeric lattice. The mechanical properties of the overall composite of embodiments in which aerogel particles have interpenetrated or interspersed with the polymeric lattice can thus be enhanced and stabilized.

For example, in one embodiment, the aerogel component can be a silica silicate having an average particle size of about 5-15 microns, a porosity of about 90% or more, a bulk density of about 40-100 $kg/m^3$, and a surface area of about 600-800 $m^2/g$. Of course, materials having one or more properties outside of these ranges can be used, as desired.

Depending upon the properties of the aerogel components, the aerogel components can be used as is, or they can be chemically modified. For example, aerogel surface chemistries can be modified for various applications, for example, the aerogel surface can be modified by chemical substitution upon or within the molecular structure of the aerogel to have hydrophilic or hydrophobic properties. For example, chemical modification can be desired so as to improve the hydrophobicity of the aerogel components. When such chemical treatment is desired, any conventional chemical treatment well known in the art can be used. For example, such chemical treatments of aerogel powders can include replacing surface hydroxyl groups with organic or partially fluorinated organic groups, or the like.

In general, a wide range of aerogel components are known in the art and have been applied in a variety of uses. For example, many aerogel components, including ground hydrophobic aerogel particles, have been used as low cost additives in such formulations as hair, skincare, and antiperspirant compositions. One specific non-limiting example is the commercially available powder that has already been chemically treated, Dow Corning VM-2270 Aerogel fine particles having a size of about 5-15 microns.

In embodiments, the powder coating composition can comprise at least the above-described aerogel that is at least one of dispersed in or bonded to the fluoropolymer component. In some embodiments, the aerogel is uniformly dispersed in and/or bonded to the fluoropolymer component, although non-uniform dispersion or bonding can be used in embodiments to achieve specific goals. For example, in embodiments, the aerogel can be non-uniformly dispersed or bonded in the fluoropolymer component to provide a high concentration of the aerogel in release/outer layers, substrate layers, different portions of a single layer, or the like.

Any suitable amount of the aerogel can be incorporated into the fluoropolymer component, to provide desired results. For example, the coating/outer layer can be formed from about 0.1 weight percent to about 10 weight percent aerogel of the total weight of the coating, from about 0.2 weight percent to about 5 weight percent aerogel of the total weight of the coating, or from about 0.5 weight percent to about 2 weight percent of the total weight of the coating. The size of aerogel particles can be from about 1 μm to about 100 μm, about 3 μm to about 50 μm, or about 5 μm to about 20 μm.

An exemplary embodiment of a release layer/outer layer includes at least one fluoropolymer having aerogel particles and optionally, positive tribocharging particles/positively charged particles dispersed therein. In embodiments, the fluoropolymer-containing particles can comprise at least one of polytetrafluoroethylene; perfluoroalkoxy polymer resin; copolymers of tetrafluoroethylene and hexafluoropropylene; copolymers of hexafluoropropylene and vinylidene fluoride; terpolymers of tetrafluoroethylene, vinylidene fluoride, and hexafluoropropylene; tetrapolymers of tetrafluoroethylene, vinylidene fluoride, hexafluoropropylene and a cure site monomer, and mixtures thereof. The fluoropolymer-containing particles can provide chemical and thermal stability and can have a low surface energy. The fluoropolymer-containing particles can have a melting temperature of from about 255° C. to about 360° C. or from about 280° C. to about 330° C. In some embodiments, the fluoropolymer-containing particles can have an average particle size between about 5 microns and about 50 microns, between about 5 microns and about 40 microns, or between about 7 microns and about 30 microns. In certain embodiments, the fluoropolymer-containing particles can have an average particle size of about 15 microns.

As discussed above, in certain embodiments, the powder coating composition can further comprise a plurality of positively charged particles (tribocharging particles) comprising alumina, silica, zirconia, germania, or other positively charged metal oxide materials. Metal oxide positively charged particles can be formed from fumed metal oxides, precipitated metal oxides, or from a gel. In some embodiments, the powder coating composition can comprise a plurality of positively charged particles comprising silica. In certain embodiments, the plurality of positively charged particles can comprise fumed silica. Positively charged particles (e.g., positive tribocharging particles) can be treated with a hydrophobic agent to render the particles hydrophobic, in some embodiments. Hydrophobic agents that can be used include organosilane, organosiloxane, polyorganosiloxane, organosilazane, and polyorganosilazanes, among others known in the art. The positively charged particles can be treated with surface agents, in certain embodiments.

The positively charged particles can improve charging characteristics of the powder coating composition, improve fluidization, improve transport through hoses, improve resistance to blocking and impact fusion, result in a better spray pattern, result in a lower angle of repose (height of cone), and result in reduced moisture sensitivity.

The addition of positive tribocharging particles (e.g., positively charged particles) to the powder coating composition comprising fluoropolymer-containing particles, such as PFA particles, and aerogel particles, such as silica aerogel particles, enables powder coating processing. Fluoropolymers carry a partial negative charge, as do aerogel particles. Submicron-sized, positively charged, tribocharging particles (positively charged particles) can associate with both fluoropolymer-containing particles and aerogel particles, acting as an associating component between particles, and enabling the two-component mixture to behave as a single powder.

The consequences of powder association during the powder coating process are both the formation of a homogeneous mixture, and the maintenance of the desired aerogel ratio while coating, without loss of uniform density of the low-density aerogel particle in the mixture. Association between powders can also aid in the wetting of melted fluoropolymer-containing particles with aerogel particles to yield cohesive coatings that are free of voids and suitable for use in low gloss fusing applications.

In certain embodiments, the powder coating composition can comprise between about 0.1 weight percent and about 5 weight percent, between about 0.2 weight percent and about 3 weight percent, or between about 0.5 weight percent and about 1.5 weight percent positively charged particles of the total solids in the powder coating composition. In some embodiments, the positively charged particles can have an average particle size between about 5 nm and about 1 μm, between about 10 nm and about 500 nm, or between about 20 nm and about 100 nm.

In some embodiments, the powder coating composition can comprise positively charged particles that comprise fumed alumina particles having a surface area per gram of between about 30 $m^2/g$ and about 400 $m^2/g$, between about 50 $m^2/g$ and about 300 $m^2/g$, or between about 100 $m^2/g$ and about 200 $m^2/g$.

In certain embodiments, the powder coating composition can comprise between about 0.1 weight percent and about 10 weight percent aerogel particles of the total solids in the powder coating composition, between about 70 weight percent and about 99 weight percent fluoropolymer-containing particles of the total solids in the powder coating composition, and, optionally, between about 0.1 weight percent and about 5 weight percent positively charged particles of the total solids in the powder coating composition, wherein the positively charged particles comprise alumina, silica, zirconia, or germania. In some embodiments, the positively charged particles can comprise alumina.

Additives and additional conductive or non-conductive fillers can be present in the release layer/outer layer. In various embodiments, other filler materials or additives including, for example, inorganic particles, can be used for the powder coating composition and the subsequently formed release layer. Conductive fillers used herein can include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly(p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

Prior to powder coating, a powder combination must be mixed to form a homogenous powder, in order to produce a homogenous topcoat/outer layer. Powder mixtures of fluoropolymer and aerogel can be provided using an acoustic mixing process, in some embodiments. Using an acoustic mixing process, fluoropolymer particles and aerogel particles such as silica aerogel can be combined to produce a powder mixture suitable for powder coating. Other additives can also be efficiently dispersed within the powder mixture.

Effective mixing using the acoustic mixer takes place at the resonant frequency for the powder mixture and container (the mixing system) and can be mixed in about 1 minute to about 5 minutes, or in embodiments from about 1.5 minutes to about 4 minutes, or in embodiments from about 2 minutes to about 3 minutes. The low frequency of mixing in an acoustic mixer allows for gentle mixing of particles, and does not result in the breakage of the friable aerogel particles. Maintaining intact aerogel particles without creating fine particles can be important for maintaining the desired size of aerogel particles for low-gloss or other applications requiring surface texture, and maintaining wettability during curing, as fine aerogel particles inhibit wetting to produce non-cohesive topcoat/release layers. The acoustic mixing process is easily scalable. Acoustic mixing also allows for efficient addition of positively charged particles to fluoropolymer and aerogel mixtures. The addition of positive alumina tribocharging fine particles to fluoropolymer/aerogel mixtures has been demonstrated to associate partially negative PFA and partially negative aerogel particles together to promote a homogeneous powder mixture.

Alumina positively charged particles also promote wettability and cohesion during the cure. The proposed acoustic mixing method effectively disperses positively charged particles. Multiple benefits for acoustic mixing of PFA/aerogel powders are evident.

Disclosed herein is an acoustic mixing process for efficiently mixing together fluoropolymer-containing particles, aerogel particles, and optionally positive tribocharging particles. The acoustic mixer uses low-frequency, high intensity acoustic energy, whereby a shear field is applied throughout the sample container. The acoustic mixing process is gentle enough that the aerogel particles are not broken down to create fine particles that can lead to poor curing of topcoats. Acoustic mixing also enables more homogeneous coatings through even distribution of positively charged particles that can provide efficient flow of powder mixtures as well as association between dissimilar particles. Finally, the mixing time of approximately 2 minutes used for acoustic mixing can save time and resources compared to alternative techniques.

Resonant acoustic mixing is distinct from conventional impeller agitation found in a planetary mixer or ultrasonic mixing. Low frequency, high-intensity acoustic energy is used to create a uniform shear field throughout the entire mixing vessel. The result is rapid fluidization (like a fluidized bed) and dispersion of material. In addition, resonant acoustic mixing is distinct from high shear cavitation mixing.

Resonant acoustic mixing differs from ultrasonic mixing in that the frequency of acoustic energy is orders of magnitude lower. As a result, the scale of mixing is larger. Unlike impeller agitation, which mixes by inducing bulk flow, the acoustic mixing occurs on a microscale throughout the mixing volume.

In acoustic mixing, acoustic energy is delivered to the components to be mixed. An oscillating mechanical driver creates motion in a mechanical system comprised of engineered plates, eccentric weights and springs. This energy is then acoustically transferred to the material to be mixed. The underlying technology principle is that the system operates at resonance. In this mode, there is a nearly complete exchange of energy between the mass elements and the elements in the mechanical system.

In a resonant acoustic mixing, the only element that absorbs energy (apart from some negligible friction losses) is the mix load itself. Thus, the resonant acoustic mixing provides a highly efficient way of transferring mechanical energy directly into the mixing materials. The resonant frequency can be from about 15 Hertz to about 2000 Hertz, or in embodiments from about 20 Hertz to about 1800 Hertz, or from about 20 Hertz to about 1700 Hertz. The resonant acoustic mixing can be performed at an acceleration G force of from about 5 to about 100.

Acoustic mixers rely on a low frequency and low shear resonating energy technology to maximize energy efficiency for mixing. The resonant acoustic mixers vigorously shake the dispersion with up to 100 G of force. The dispersion can be mixed at a resonant frequency to maximize energy usage. The process utilizes high intensity, low shear vibrations which induce the natural separation of loosely aggregated particles while simultaneously mixing all regions of the dispersion. This technology can be useful for high viscosity systems. Resonant acoustic mixers are available from Resodyn™ Acoustic Mixers.

Embodiments are drawn to methods of making a fuser member, comprising applying a powder coating composition to the surface of a fuser member via an electrostatic gun. The powder coating composition can be as described above, comprising a mixture of at least two materials having different densities (e.g., a mixture of a plurality of aerogel particles and a plurality of fluoropolymer-containing particles), and optionally, positively charged particles. The fuser member is grounded during application of the powder coating composition. The electrostatic gun can comprise at least one electrode and a high-voltage generator, and the high-voltage generator can generate a negative polarity voltage between about 0 KV and about 100 KV or between about 20 KV and about 100 KV that is applied to the electrode during application of the powder coating composition. The electrostatic gun can have a round spray nozzle/tip or a flat spray nozzle/tip.

The fuser member can be any known in the art that is suitable for powder coating. In some embodiments, the fuser member can be a TOS (TEFLON® over silicone) production roll. The fuser member (e.g., fuser roll, among others) can include a substrate having one or more functional layers formed thereon. The one or more functional layers can include a surface coating or release/outer layer having a surface wettability that is hydrophobic and/or oleophobic; ultrahydrophobic and/or ultraoleophobic; or superhydrophobic and/or superoleophobic. Such a fuser member can be used as an oil-less fuser member for high speed, high quality electrophotographic printing to ensure and maintain a good toner release from the fused toner image on the supporting material (e.g., a paper sheet), and further assist paper stripping.

In various embodiments, the fuser member can include, for example, a substrate, with one or more functional layers formed thereon. The substrate can be formed in various shapes, e.g., a cylinder (e.g., a cylinder tube), a cylindrical drum, a belt, a drelt, or a film, using suitable materials that are non-conductive or conductive depending on a specific configuration.

Figure 2:
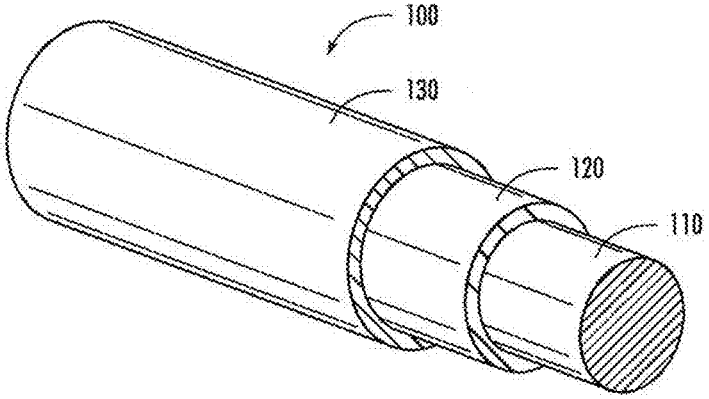
FIG. 2 depicts an exemplary fuser member having a cylindrical substrate in accordance with certain embodiments.
Figure 3:
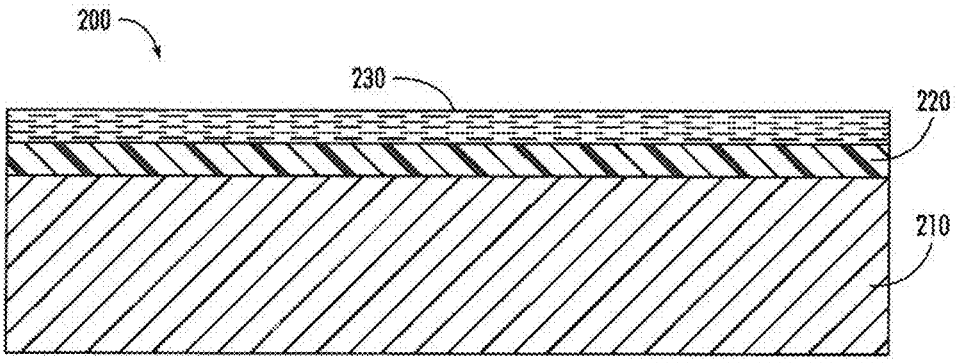
FIG. 3 depicts an exemplary fuser member having a belt substrate in accordance with some embodiments.

Specifically, FIG. 2 depicts an exemplary fuser member 100 having a cylindrical substrate 110 and FIG. 3 depicts another exemplary fuser member 200 having a belt substrate 210 in accordance with the present teachings. It should be readily apparent to one of ordinary skill in the art that the fuser member 100 depicted in FIG. 2 and the fuser member 200 depicted in FIG. 3 represent generalized schematic illustrations and that other layers/substrates can be added or existing layers/substrates can be removed or modified.

In FIG. 2 the exemplary fuser member 100 can be a fuser roller having a cylindrical substrate 110 with one or more functional layers 120 (also referred to as intermediate layers) and an outer/release layer 130 formed thereon. In various embodiments, the cylindrical substrate 110 can take the form of a cylindrical tube, e.g., having a hollow structure including a heating lamp therein, or a solid cylindrical shaft. In FIG. 3, the exemplary fuser member 200 can include a belt substrate 210 with one or more functional layers, e.g., 220 and an outer surface 230 formed thereon. The belt substrate 210 and the cylindrical substrate 110 can be formed from, for example, polymeric materials (e.g., polyimide, polyaramide, polyether ether ketone, polyetherimide, polyphthalamide, polyamide-imide, polyketone, polyphenylene sulfide, fluoropolyimides or fluoropolyurethanes, among others) and metal materials (e.g., aluminum or stainless steel, among others) to maintain rigidity and structural integrity as known to one of ordinary skill in the art.

The substrate layer 110, 210 in FIGS. 2 and 3 can be in a form of, for example, a belt, plate, and/or cylindrical drum for the disclosed fuser member. The substrate of the fuser member is not limited, as long as it can provide high strength and physical properties that do not degrade at a fusing temperature. Specifically, the substrate can be made from a metal, such as aluminum or stainless steel or a plastic of a heat-resistant resin. Examples of the heat-resistant resin include a polyimide, an aromatic polyimide, polyether imide, polyphthalamide, polyester, and a liquid crystal material such as a thermotropic liquid crystal polymer, and the like. The thickness of the substrate falls within a range where rigidity and flexibility enabling the fuser belt to be repeatedly turned can be compatibly established, for instance, ranging from about 10 micrometers to about 200 micrometers or from about 30 micrometers to about 100 micrometers.

Examples of functional layers 120 and 220 include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RN, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as, polydimethylsiloxanes); fluorosilicones, such as, Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Examples of functional layers 120 and 220 also include fluoroelastomers. Fluoroelastomers can be from the class of 1) copolymers of two of vinylidenefluoride, hexafluoropropylene, and tetrafluoroethylene; such as those known commercially as VITON A®; 2) terpolymers of vinylidenefluoride, hexafluoropropylene, and tetrafluoroethylene, such as, those known commercially as VITON B®; and 3) tetrapolymers of vinylidenefluoride, hexafluoropropylene, tetrafluoroethylene, and a cure site monomer, such as those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS1, a poly(propylene-tetrafluoroethylene), and FLUOREL II® (LII900) a poly(propylene-tetrafluoroethylenevinylidenefluoride), both also available from 3M Company, as well as, the tecnoflons identified as FOR-60KIR®, FOR-LHF®, NM® FOR-THF®, Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

For a roller configuration, the thickness of the functional layer can be from about 0.5 mm to about 10 mm, from about 1 mm to about 8 mm, or from about 2 mm to about 7 mm. For a belt configuration, the functional layer can be from about 25 microns up to about 2 mm, from about 40 microns to about 1.5 mm, or from about 50 microns to about 1 mm.

Optionally, any known and available suitable adhesive layer, also referred to as a primer layer, can be positioned between the release layer 130, 230, the intermediate layer 120, 220 and the substrate 110, 210. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. Optionally, any known and available suitable adhesive layer can be positioned between the release layer or outer surface, the functional layer and the substrate. The adhesive layer can be coated on the substrate, or on the functional layer, to a thickness of from about 2 nanometers to about 10,000 nanometers, from about 2 nanometers to about 1,000 nanometers, or from about 2 nanometers to about 5000 nanometers. The adhesive can be coated by any suitable known technique, including spray coating or wiping.

The electrostatic gun used in powder coating a fuser member can comprise at least one electrode and a high-voltage generator, and the high-voltage generator can generate a negative polarity voltage between about 0 KV and about 100 KV, between about 20 KV and about 80 KV, or between about 40 KV and about 60 KV that is applied to the electrode during application of the powder coating composition. In some embodiments, a negative polarity voltage of about 100 kilovolts (kV or KV) is generated by the high-voltage generator and applied to the electrode during application of the powder coating composition to the fuser member. In certain embodiments, the electrostatic gun can have a round spray nozzle/tip.

In some embodiments, the method can further comprise curing the applied powder coating composition, thereby forming an outer layer/release layer on the fuser member. The curing can comprise heating the applied powder coating composition to a temperature between about 255° C. and about 400° C., between about 260° C. and about 380° C., or between about 280° C. and about 350° C., in certain embodiments. In some embodiments, the release layer/outer layer can have a thickness of between about 5 microns and about 250 microns, between about 10 microns and about 100 microns, or between about 15 microns and about 50 microns. In embodiments, the release layer/outer layer can have a surface gloss of between about 5 ggu (Gardner gloss units) and about 45 ggu, between about 10 ggu and about 40 ggu, or between about 15 ggu and about 35 ggu when measured at 75°.

Additives and additional conductive or non-conductive fillers can be present in the intermediate layer substrate layers 110 and 210, the intermediate layers 120 and 220 and the release layers 130 and 230. In various embodiments, other filler materials or additives including, for example, inorganic particles, can be used for the coating composition and the subsequently formed release/outer layer. Conductive fillers used herein can include carbon blacks such as carbon black, graphite, fullerene, acetylene black, fluorinated carbon black, and the like; carbon nanotubes; metal oxides and doped metal oxides, such as tin oxide, antimony dioxide, antimony-doped tin oxide, titanium dioxide, indium oxide, zinc oxide, indium oxide, indium-doped tin trioxide, and the like; and mixtures thereof. Certain polymers such as polyanilines, polythiophenes, polyacetylene, poly(p-phenylene vinylene), poly (p-phenylene sulfide), pyrroles, polyindole, polypyrene, polycarbazole, polyazulene, polyazepine, poly(fluorine), polynaphthalene, salts of organic sulfonic acid, esters of phosphoric acid, esters of fatty acids, ammonium or phosphonium salts and mixtures thereof can be used as conductive fillers. In various embodiments, other additives known to one of ordinary skill in the art can also be included to form the disclosed composite materials.

Embodiments are drawn to a fuser member comprising a substrate; and an outer layer disposed on the substrate. The outer layer can comprise a fluoropolymer-containing matrix comprising between about 0.1 weight percent and about 10 weight percent aerogel particles and between about 0.1 weight percent and about 5 weight percent fumed alumina particles of the total solids in the outer layer. The outer layer can have a surface gloss of between about 5 ggu (Gardner gloss units) and about 45 ggu when measured at 75°. Further, the outer layer can be prepared by a powder coating method, as discussed above. For example, the outer layer can be prepared by a method comprising applying a powder coating composition to the surface of a grounded fuser member via an electrostatic gun. The electrostatic gun (voltage settings and nozzle/tip geometry) can be as discussed above.

In some embodiments, a low gloss fuser member can be fabricated by incorporating an aerogel (e.g., silica aerogel) into a fluoropolymer-containing (perfluoroalkoxy) topcoat/outer layer using positively charged particles comprising alumina, silica, zirconia, or germania (e.g., tribo-charging powder additives). Aerogel in the outer layer/release layer of a fuser member can provide fine surface roughness, which translates into printed images having lower gloss. Thus, uniform aerogel deposition can provide fine surface roughness to an outer layer and can permit the production of uniform low gloss prints via a low gloss fuser member of embodiments. Powder coating of a fuser member is desirable due to its being fast and clean (no solvent involved). However, process conditions for powder coating a fuser member are nontrivial. For example, it can be difficult to create low gloss fuser members for commercial processes, because of poor (e.g., non-uniform) aerogel deposition.

Certain embodiments are drawn to powder coating processes for fabricating low gloss TEFLON® PFA (perfluoroalkoxy) fuser outer layers/release layers using a powder coating composition/mixture containing aerogel silica particles (average particle size of about 15 μm), alumina particles (average particle size of about 50 nm) and PFA particles (average particle size of about 15 μm). As the low gloss feature of a print comes from indentations in the image area (toner layer) by the aerogel silica on the fuser member surface, aerogel deposition quality/uniformity is very important. In embodiments, a round tip nozzle geometry and specific negative polarity settings (between about 50 kV and about 100 kV) on an electrostatic (corona) gun are used for producing rolls with different levels of low gloss. The powder coat provided having an even distribution of texture forming particles (e.g., aerogel) can enable transfer of toner to form films of variable gloss.

Some embodiments are drawn to methods of preparing a low gloss print comprising printing a toner image on a substrate with an electrophotographic imaging apparatus or printer comprising a fuser member of embodiments as discussed above (e.g., a fuser member having an outer layer with a surface gloss of between about 5 ggu and about 45 ggu when measured at 75°). The printed toner image can have a gloss of between about 20 ggu and about 45 ggu when measured at 75°, when printed on a substrate (e.g., paper) having a gloss of greater than about 45 ggu, greater than about 55 ggu, greater than about 65 ggu, or greater than about 70 ggu when measured at 75°. In some embodiments the substrate can have a gloss between about 45 ggu and about 75 ggu, between about 55 ggu and about 73 ggu, between about 65 ggu and about 73 ggu, or between about 70 ggu and about 73 ggu. The printed toner image can comprise at least one of cyan, magenta, yellow and black single layer colors and red, green and blue process colors. The substrate can be matte or glossy paper in some embodiments. The substrate can be coated paper in certain embodiments. In some embodiments, the toner used to prepare the low gloss print can also be used in preparing high gloss toner prints by using an electrophotographic imaging apparatus or printer comprising a fuser member having a surface gloss of greater than 45 ggu, greater than about 50 ggu, greater than about 60 ggu, or greater than about 70 ggu when measured at 75°. Thus, in certain embodiments, the toner can be a high gloss toner.

The following Examples further define and describe embodiments herein. Unless otherwise indicated, all parts and percentages are by weight.

EXAMPLES

1. Preparation of Powder Coating Composition 100 g PFA 320 (perfluoroalkoxy fluoropolymer) powder (available from DuPont), 1.25 g VM-2270 aerogel silica particles (Dow Corning®), and 0.125 g SpectrAl® 100 (fumed alumina from CABOT Corporation) were sieved through a 125 μm sieve, and mixed using a Resodyn™ acoustic mixer for 4 minutes at 100% intensity.

2. Powder Coating Process

The powder coating composition was placed in a mini-hopper (Nordson Corporation), which was placed on top of a vibrating bed. To fluidize the powder coating composition, an air supply was connected and the air pressure was set at 0.2 bar (as recommended by the manufacturer). The vibration intensity of the vibrating bed was set at 70% to help the materials flow. For general studies, a blank silicone fuser roll was used. For machine testing, a blank silicone roll was first sprayed with a thin layer of primer PL-990CL (DuPont) at a thickness of about 3 μm to about 5 μm to permit adhesion of the powder coating composition to the silicone. The primer dried quickly as the roll was preheated in the oven at 120° C. for 20 minutes.

Figure 4:
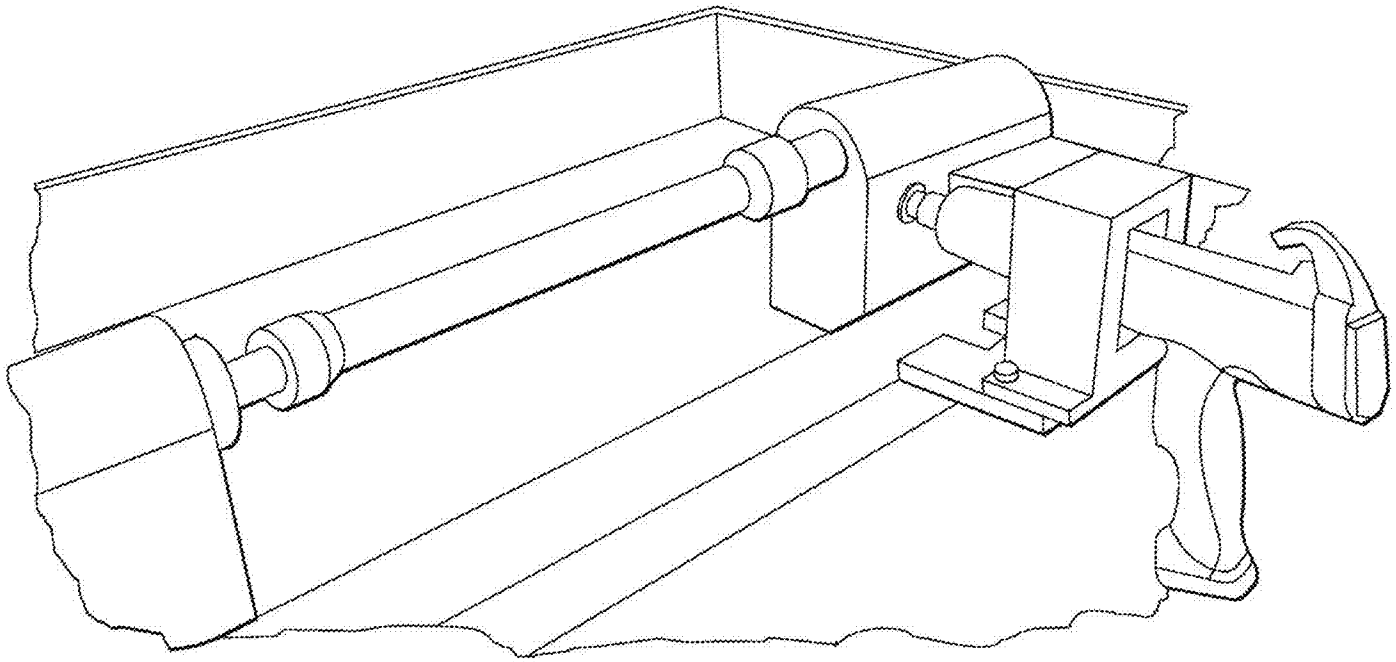
FIG. 4 is a photograph showing a fuser roll mounted on a rotation stage for uniform powder deposition and a powder coating electrostatic (corona) gun mounted on a translation stage.

A fuser roll was mounted on a rotation stage for uniform powder deposition as shown in FIG. 4. Also shown in FIG. 4, the powder coating electrostatic (corona) gun was mounted on a translation stage. The electrostatic gun was used with either a flat tip nozzle geometry or a round tip nozzle geometry. Further, a negative polarity voltage of 100 kilovolts (kV) was applied to the electrode in the nozzle/tip of the electrostatic gun. The powder was uniformly delivered to the roll as the gun moved from one end to the other. After coating, the fuser roll was baked in the oven for 31 minutes at 340° C. to melt the powder coating composition to form a coating.

3. Characterization of the Powder Coated Fuser Rolls

The roll gloss of each roll was measured using a BYK Gardner 75 degree gloss meter and the gloss reading was taken with the gloss meter along the fuser roll.

Table 1 (below) summarizes the powder coating settings for two rolls and the corresponding gloss (75 degree) measurements of the coatings.

| Sample ID | KV | uA | Flow Air (SCFM) | Atomizing Air (SCFM) | Rotating (RPM) | Translation (mm/s) | Gun to roll (in) | Nozzle | Roll gloss |
|---|---|---|---|---|---|---|---|---|---|
| AZ30935-07-SY13 | 100 | 1.5 | 0.6 | 1 | 220 | 60 | 4.5 | flat tip | 54.6 |
| AZ30935-07-SY15 | 100 | 1.5 | 0.6 | 1 | 220 | 60 | 4.5 | round tip | 24.4 |

Changing the geometry of the nozzle/tip resulted in a change in gloss of the roll produced from 54.6 ggu for the flat tip to 24.4 ggu for the round tip. Prints made using these fuser rolls are predicted to have a gloss of 50 ggu and 25 ggu, respectively. (See FIG. 1, correlating roll gloss to print gloss.) Thus, use of the round tip on the electrostatic gun during powder coating permitted production of a fuser roll that can be used to produce low gloss prints with a powder coating composition prepared as discussed above.

Figure 5A:
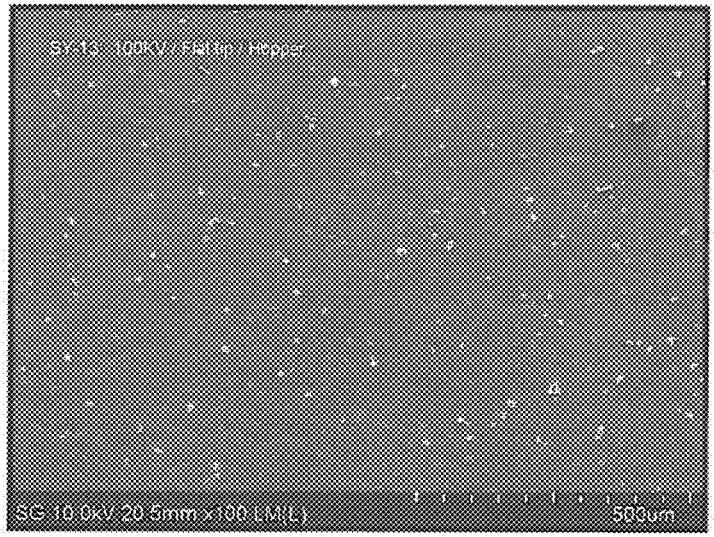
FIG. 5*a*) shows the surface of a powder coated fuser roll made with a flat tip nozzle and FIG. 5*b*) shows the surface of a powder coated fuser roll made with a round tip nozzle.
Figure 5B:
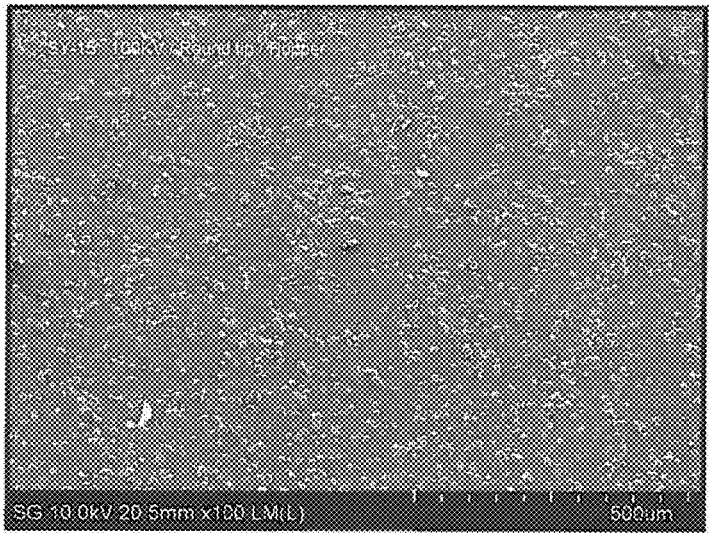
FIG. 5 includes images of the surface of powder coated fuser rolls taken with a scanning electron microscope (SEM).

Images of the surface of the powder coated rolls taken with a scanning electron microscope (SEM) are shown in FIGS. 5*a*) and 5*b*). FIG. 5*a*) shows the surface of the powder coated roll made with a flat tip nozzle and FIG. 5*b*) shows the surface of the powder coated roll made with a round tip nozzle. The roll made with a round tip geometry (FIG. 5*b*)) had more aerogel deposition on the roll, which reduced its roll gloss.

Figure 6:
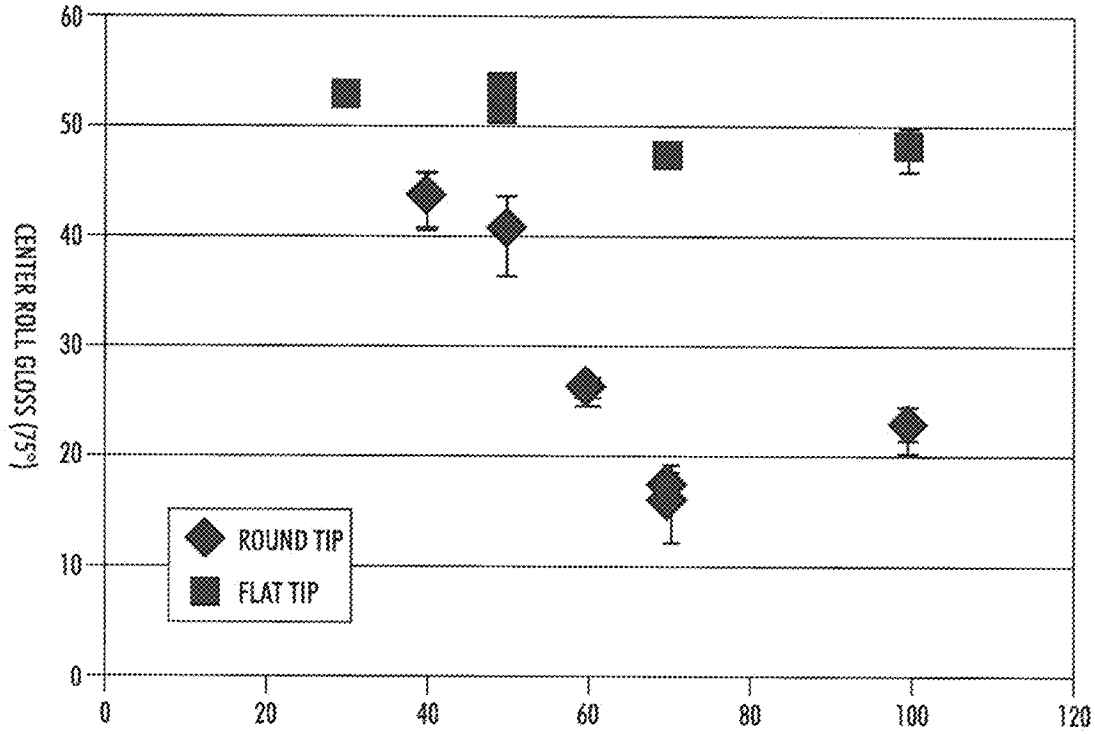
FIG. 6 is a graph showing roll gloss as a function of the kV (negative polarity voltage) settings on an electrostatic (corona) gun used for powder coating. Results for both a round tip and flat tip nozzle geometry on the electrostatic (corona) gun are shown.

4. Effect of Kilovolt (kV or KV) Settings of Electrostatic Gun on Roll Gloss FIG. 6 shows the roll gloss as a function of the kV (negative polarity voltage) settings on the electrostatic (corona) gun used for powder coating. The kV settings on the corona gun (in addition to the spray nozzle/tip geometry) affect the roll gloss produced. For the flat nozzle/tip, the roll gloss was not very sensitive to kV settings, as the roll gloss stayed relatively high over the whole kV range. However, for the round nozzle/tip, the roll gloss adjusted up and down in relation to the kV setting used. An optimum kV setting that will permit the greatest amount of aerogel deposition and consequently, reduction in gloss can be ascertained.

5. Machine Testing of Powder Coated Fuser Roll

A low gloss roll was prepared as described above, except that the kV setting of the electrostatic gun was at 50 kV. The roll gloss measured for the roll produced at the 50 kV setting was about 35 ggu.

Experimental powder coated rolls were tested using a Xerox 700 Digital Color Press. A TOS (TEFLON@ over silicone) production roll was removed from a fuser CRU (customer replaceable unit) and replaced with the powder coated roll. The CRU was then placed into the Xerox 700 Digital Color Press and prints were made using a standard gloss target with either uncoated paper (Xerox Color Xpressions Select 90 g/m$^2$) or coated paper (Xerox Digital Color Elite Gloss 120 g/m$^2$). Standard printer settings were used for these tests. Gloss of the prints (single layers for the colors cyan, yellow, magenta and black, as well as two layers for the colors red, green and blue) were measured using a BYK Gardner 75 degree gloss meter.

Figure 7A:
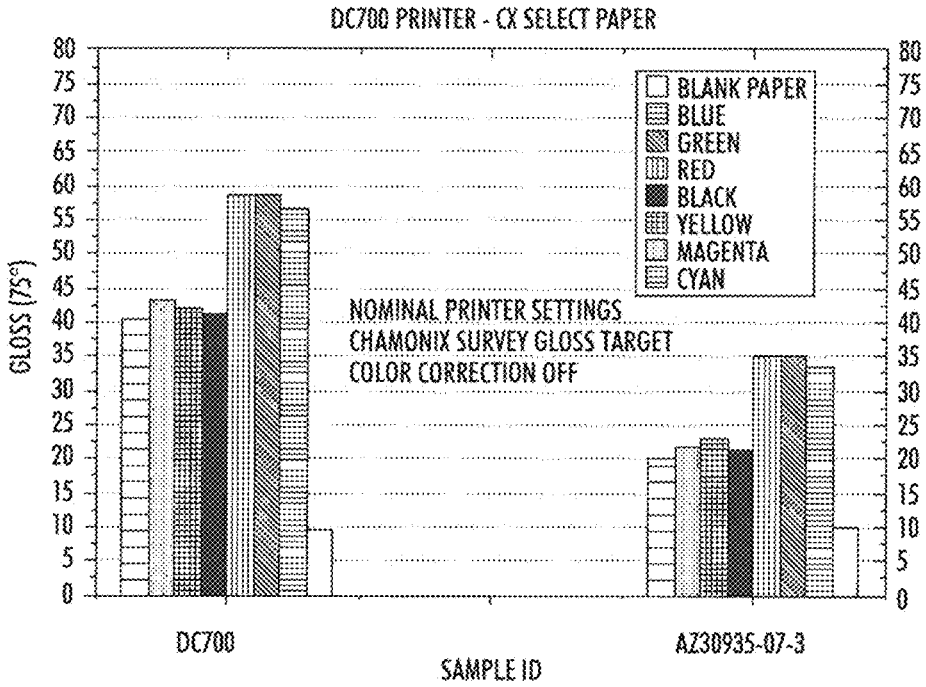
FIG. 7*a*) shows results for colors printed on CXS paper comparing the fuser roll that is standard in the Xerox 700 Digital Color Press and a roll of certain embodiments prepared using a 50 kilovolt (kV or KV) setting (negative polarity voltage) on an electrostatic powder coating gun and having a 75 degree roll gloss of about 35 ggu.
Figure 7B:
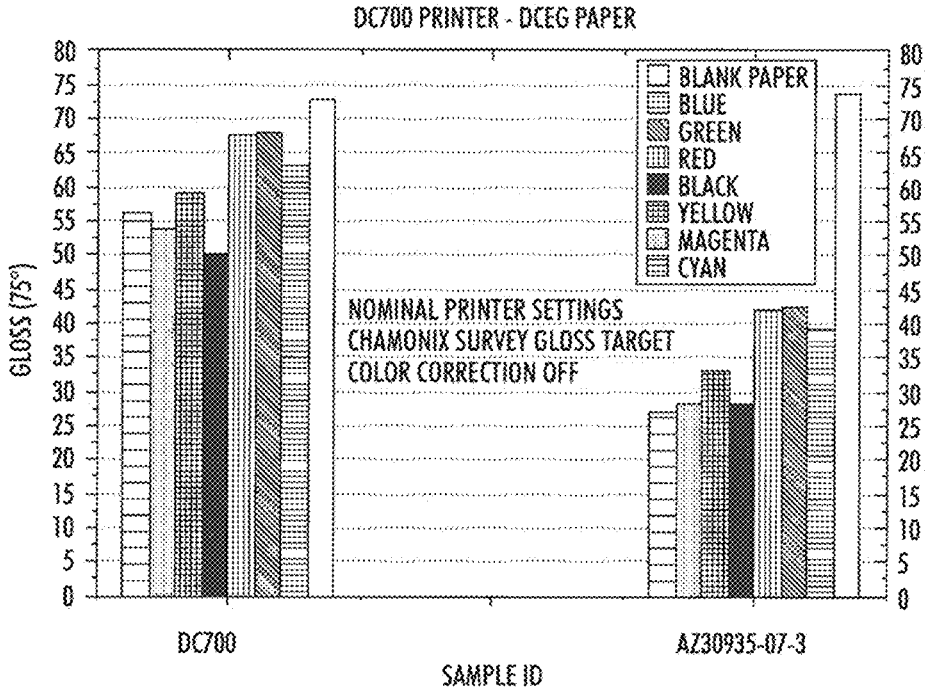
FIG. 7*b*) shows results for colors printed on DCEG paper comparing the fuser roll that is standard in the Xerox 700 Digital Color Press and a roll of some embodiments prepared using a 50 kV setting on an electrostatic powder coating gun and having a 75 degree roll gloss of about 35 ggu.

Extended print runs with the test rolls were also conducted with the Xerox 700 Digital Color Press. For 10,000 page (10 KP) print tests, Xerox Color Xpressions Planet 213 g/m$^2$ paper was run through the printer and, at every 1000 page interval, the color targets were printed to determine how print gloss values varied. FIG. 7 shows measured gloss for different colors using the Color Xpressions Select (CXS) paper and the Digital Color Elite Gloss (DCEG) paper. FIG. 7*a*) shows results for colors printed on CXS paper comparing the fuser roll that is standard in the Xerox 700 Digital Color Press and the roll prepared using the 50 kV setting having a 75 degree roll gloss of about 35 ggu. FIG. 7*b*) shows results for colors printed on DCEG paper comparing the fuser roll that is standard in the Xerox 700 Digital Color Press and the roll prepared using the 50 kV setting having a 75 degree roll gloss of about 35 ggu. The roll produced as discussed above had a low print gloss compared with the DC700 control fuser roll.

FIG. 7 shows the measured print gloss for cyan, magenta, yellow and black single layer colors and red, green and blue process colors, together with plain paper gloss. The low gloss rolls permitted production of low gloss prints on both CXS (uncoated) and DCEG (coated) paper substrates compared with the DC700 fuser roll control (standard fuser roll supplied for the Xerox 700 Digital Color Press.

Figure 8:
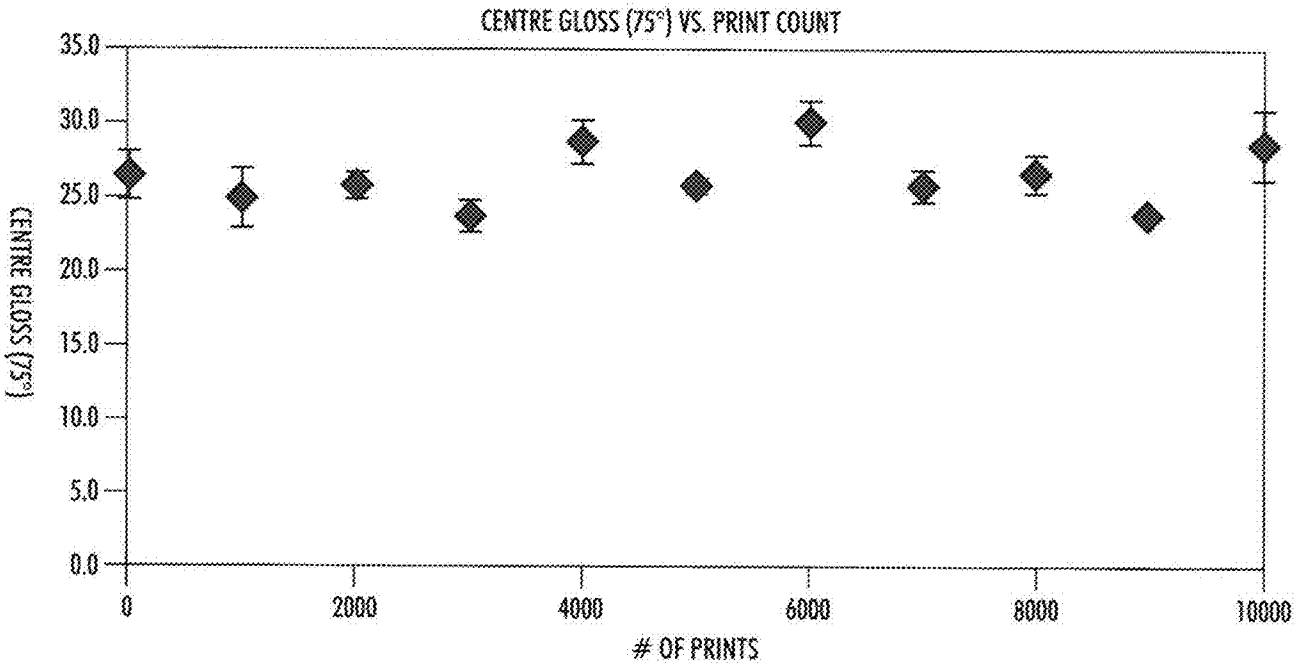
FIG. 8 is a graph showing print gloss over the course of a 10,000 page (10 KP) print test on the Xerox 700 Digital Color Press run with a fuser roll produced with a 50 kV setting (negative polarity voltage) on an electrostatic powder coating gun and having a round nozzle tip.

FIG. 8 shows the print gloss over a 10 KP print test on the Xerox 700 Digital Color Press run with the fuser roll produced with the 50 kV setting on the electrostatic gun and round nozzle/tip. The low gloss feature of the print was maintained over the 10 KP print volume with black color and DCEG paper.

Figure 9:
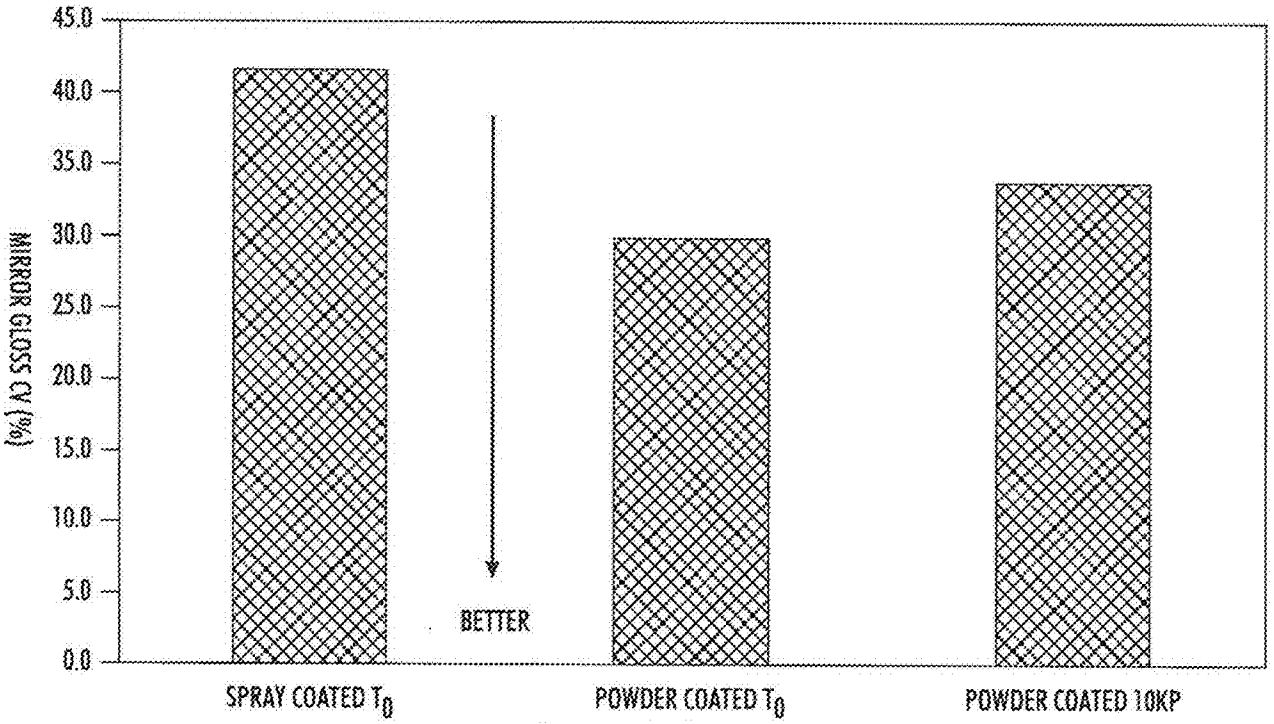
FIG. 9 is a graph correlating printed microgloss in terms of a coefficient of variance for a time zero print produced by a liquid spray coated low gloss roll, a time zero print by a powder coated roll of certain embodiments (powder coated at 50 kV and with a round tip nozzle) and a print by the same powder coated roll after a 10 KP test. The 10 KP test was performed with black color and DCEG paper.

FIG. 9 shows the microgloss in terms of the coefficient of variance for a time zero print produced by a liquid spray coated low gloss roll, a time zero print by a powder coated roll (50 KV and round tip nozzle) and a print by the same powder coated roll after a 10 KP test. Black color and DCEG paper was used for the 10 KP test. The powder coated low gloss roll had better print quality in terms of microgloss than the spray coated low gloss roll at time zero and even after a 10 KP stress test.

To the extent that the terms "containing," "including," "includes," "having," "has," "with," or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Further, in the discussion and claims herein, the term "about" indicates that the values listed can be somewhat altered, as long as the alteration does not result in nonconformance of the process or structure to the illustrated embodiment. Finally, "exemplary" indicates the description is used as an example, rather than implying that it is an ideal.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g., −1, −1.2, −1.89, −2, −2.5, −3, −10, −20, and −30, etc.

It will be appreciated that variants of the above-disclosed and other features and functions, or alternatives thereof, may be combined into many other different systems or applications. Various presently unforeseen or unanticipated alternative, modifications, variations or improvements therein may be subsequently made by those skilled in the art which are also intended to be encompassed by the following claims.

What is claimed is:

1. A method for powder coating comprising:

mixing a powder coating composition using an acoustic mixing process to form a homogeneous dry powder; and applying the homogeneous dry powder to a substrate via an electrostatic gun to form an outer layer having a surface gloss of between about 5 ggu and about 45 ggu when measured at 75° C., wherein the powder coating composition comprises a mixture of a first material and a second material and the first and second materials have different densities, wherein the substrate is grounded, and wherein the electrostatic gun comprises at least one electrode and a high-voltage generator, and the high-voltage generator generates a negative polarity voltage between about 0 KV and about 100 KV that is applied to the electrode during application of the homogeneous dry powder.

2. The method of claim 1, further comprising curing the applied powder coating composition, thereby forming a release layer on the substrate.

3. The method of claim 2, wherein the curing comprises heating the applied powder coating composition to a temperature between about 255° C. and about 400° C.

4. The method of claim 1, wherein the negative polarity voltage is between about 20 KV and about 80 KV.

5. The method of claim 1, wherein the electrostatic gun has a round spray nozzle geometry.

6. The method of claim 1, wherein the mixture comprises a plurality of aerogel particles and the second material comprises a plurality of fluoropolymer-containing particles.

7. The method of claim 6, wherein the fluoropolymer-containing particles comprise at least one of polytetrafluoroethylene; perfluoroalkoxy polymer resin; copolymers of tetrafluoroethylene and hexafluoropropylene; copolymers of hexafluoropropylene and vinylidene fluoride; terpolymers of tetrafluoroethylene, vinylidene fluoride, and hexafluoropropylene; and tetrapolymers of tetrafluoroethylene, vinylidene fluoride, hexafluoropropylene and a cure site monomer.

8. The method of claim 6, wherein the fluoropolymer-containing particles have an average particle size between about 5 microns and about 50 microns.

9. The method of claim 6, wherein the powder coating composition further comprises a plurality of positively charged particles comprising alumina, silica, zirconia, or germania.

10. The method of claim 9, wherein the powder coating composition comprises between about 0.1 weight percent and about 5 weight percent positively charged particles of the total solids in the powder coating composition.

11. The method of claim 9, wherein the positively charged particles have an average particle size between about 5 nm and about 1 μm.

12. The method of claim 9, wherein the positively charged particles comprise fumed alumina particles having a surface area per gram between about 30 $m^2/g$ and about 400 $m^2/g$.

13. The method of claim 1, wherein the powder coating composition comprises between about 0.1 weight percent and about 5 weight percent aerogel particles of the total solids in the powder coating composition.

14. The method of claim 1, wherein the powder coating composition comprises:

between about 0.1 weight percent and about 10 weight percent aerogel particles of the total solids in the powder coating composition, between about 70 weight percent and about 99 weight percent fluoropolymer-containing particles of the total solids in the powder coating composition, and, optionally, between about 0.1 weight percent and about 5 weight percent positively charged particles of the total solids in the powder coating composition, wherein the positively charged particles comprise alumina, silica, zirconia, or germania.

15. A method of making a fuser member, comprising:

mixing a powder coating composition using an acoustic mixing process to form a homogeneous dry powder; and applying the homogeneous dry powder to the surface of a fuser member via an electrostatic gun to form an outer layer having a surface gloss of between about 5 ggu and about 45 ggu when measured at 75° C., wherein the powder coating composition comprises a mixture of a plurality of aerogel particles and a plurality of fluoropolymer-containing particles, wherein the fuser member is grounded, wherein the electrostatic gun comprises at least one electrode and a high-voltage generator, and the high-voltage generator generates a negative polarity voltage between about 0 KV and about 100 KV that is applied to the electrode during application of the homogeneous dry powder, and wherein the electrostatic gun has a round spray nozzle or a flat spray nozzle.

16. The method of claim 15, further comprising curing the applied powder coating composition, thereby forming the outer layer on the fuser member.

17. The method of claim 16, wherein the curing comprises heating the applied powder coating composition to a temperature between about 255° C. and about 400° C.

18. The method of claim 16, wherein the negative polarity voltage is between about 20 KV and about 80 KV.

19. The method of claim 16, wherein the negative polarity voltage is about 100 KV.

20. The method of claim 16, wherein the electrostatic gun has a round spray nozzle.

* * * * *